US006196482B1

(12) United States Patent
Goto

(10) Patent No.: US 6,196,482 B1
(45) Date of Patent: Mar. 6, 2001

(54) JET MILL

(75) Inventor: Shoichi Goto, Kitakyushu (JP)

(73) Assignee: Vishnu Co., Ltd., Fuknoka-Ken (JP)

( * ) Notice: Subject to any disclaimer, the term of this patent is extended or adjusted under 35 U.S.C. 154(b) by 0 days.

(21) Appl. No.: 09/401,296

(22) Filed: Sep. 23, 1999

(51) Int. Cl.[7] ..... B02C 19/06
(52) U.S. Cl. ..... 241/39; 241/41
(58) Field of Search ..... 241/38, 39, 41, 241/5

(56) References Cited

U.S. PATENT DOCUMENTS

| | | | | |
|---|---|---|---|---|
| 3,602,439 | | 8/1971 | Nakayama | 241/39 |
| 4,502,641 | * | 3/1985 | Coombe | 241/5 |
| 4,504,017 | | 3/1985 | Andrews | 241/40 |
| 4,880,169 | * | 11/1989 | Zander et al. | 241/5 |
| 5,421,524 | * | 6/1995 | Haddow | 241/5 |
| 5,423,490 | | 6/1995 | Zampini | 241/5 |

FOREIGN PATENT DOCUMENTS

| | | | |
|---|---|---|---|
| 507 026 | 6/1971 | (CH) | B02C/19/00 |
| 736328 | 10/1996 | (EP) . | |
| 2 311 588 | 5/1975 | (FR) | B02C/19/06 |
| 63-16981 | 4/1988 | (JP) | B02C/19/06 |
| 63-17501 | 4/1988 | (JP) | B02C/19/06 |
| 64-9057 | 2/1989 | (JP) | B02C/19/06 |
| 2-111459 | 4/1990 | (JP) | B02C/19/06 |
| 6-254427 | 9/1994 | (JP) | B02C/19/06 |

* cited by examiner

*Primary Examiner*—John M. Husar
(74) *Attorney, Agent, or Firm*—Sughrue, Mion, Zinn, Macpeak & Seas, PLLC

(57) ABSTRACT

The invention provides a jet mill which comprises a hollow disk-shaped turning and crushing chamber; a plurality ("m") of crushing nozzles, to form turning flows by jetting a high pressure gas, in which the jetting ports are inclined to the peripheral wall side and disposed at the sidewall of the turning and crushing chamber; a plurality ("n") of venturi nozzles, disposed at the side wall of the turning and crushing chamber, which leads materials to be crushed, in line with the high pressure gas; a solid and gas blending chamber which is formed at the upstream side of the venturi nozzles; a crushed material supplying portion communicating with the solid and gas blending chamber; a press-in nozzle disposed in the solid and gas blending chamber coaxially with the venturi nozzles; and an outlet, disposed at the upper part of the middle portion of the turning and crushing chamber, through which micro powder is discharged; wherein the dependency of materials to be crushed for collision with the wall surface in a turning and crushing chamber is lowered in order to prevent the wall surface from being worn, the dependency on collision among the materials to be crushed is increased, the pressure fitting of micro powder is remarkably reduced, the stay duration of the materials in the turning and crushing chamber is shortened, the crushing treatment capacity is remarkably improved, and a long-time continuous operation is enabled.

16 Claims, 12 Drawing Sheets form of turning flow

JET MILL

BACKGROUND OF THE INVENTION

1. Field of the Invention

The present invention relates to a jet mill of a horizontal turning flow type.

2. Description of the Prior Art

Recently, various types of jet mills have been developed, which are used in various fields such as generation, etc., of powder poor in heat such as agrichemicals, toner, etc., or ceramic powder and micro-crushed powder by bringing it into collision with each other by high speed jet.

For example, Japanese Patent Publication No. 16981 of 1988 (hereinafter called Publication "A") discloses "an ultrasonic jet mill in which a circumferential part of a circular separation chamber is caused to face a collision space between a collision plate opposed to the outlet of a main nozzle for high pressure gas jetting and the nozzle outlet, and the circular separation chamber are caused to communicate with the outlet side of a material feeding passage communicating with midway of the main nozzle in a bypass passage extending in the circumferential tangential direction of the circular separation chamber, and a discharge passage of micro powder is connected to the middle portion of said circular separation chamber. In addition, as a construction similar thereto, Japanese Laid-Open Patent Publication Nos. 50554 of 1982, 50555 of 1982, 50556 of 1982, 290560 of 1992, 184966 of 1993, 275731 of 1995, 152742 of 1996, 155324 of 1996, 182937 of 1996, 254855 of 1996, 323234 of 1996, Japanese Utility Model Publication Nos. 52110 of 1991, 53715 of 1995, 8036 of 1995, and Laid-Open Utility Model Publication No. 19836 of 1994 have been known.

Japanese Patent Publication No. 17501 of 1988 (hereinafter called Publication "B") discloses "a jet mill having, at one end thereof, a solid and gas blending chamber formed, in which a material feeding port and a crushed material feeding nozzle for jetting a high pressure gas are opened adjacent to each other, and, at the other end, a turning and crushing chamber is formed, in which a collision plate is provided and a crushing nozzle for jetting a high pressure gas is disposed, wherein one end of the solid and gas blending chamber is caused to communicate with one end of the turning and crushing chamber by an accelerator tube opposite to the collision plate, a screening chamber which communicates with the turning and crushing chamber is formed via a rectification zone on the outer circumference of the accelerator tube, and further an annular screening plate which encloses the accelerator tube is provided in the screening chamber with its interior communicated with the discharge hole and its exterior communicated with the solid and gas blending chamber.

Japanese Patent Publication No. 9057 of 1989 (hereinafter called Publication "C") improves the jet mill disclosed by patent "B" and discloses "a jet mill provided with a projection (center pole), the center portion of which protrudes mostly toward the center of the outlet of the accelerator, on the collision plate".

Japanese Laid-Open Patent Publication No. 254427 of 1994 (hereinafter called Publication "D") discloses "a jet mill comprising a plurality of crushing nozzles for forming turning flows by jetting a high pressure gas into a turning and crushing chamber, and a collision member provided opposite to the jetting portions of the respective crushing nozzles, wherein the collision member is a flat collision plate, the shape at the downward end and upward end along the turning flow direction of which is formed to be thin like a blade, the collision face is located in the flow direction of the turning flows, and is inclined so that an angle a formed by the collision face and the center line of the crushing nozzles opposite thereto in a range from 30 to 60 degrees, and the collision member is disposed and fixed by an attaching means, the angle of which is adjustable."

Japanese Laid-Open Patent Publication No. 111459 of 1990 (hereinafter called Publication "E") discloses "a jet mill in which the widening angle of an accelerator tube is formed to be 7 through 9 degrees." In addition, Japanese Utility Model Publication No. 25227 of 1995 is known as its equivalent.

Further, a prior art jet mill was such that crushed material feeding nozzles and jet nozzles for jetting a high pressure gas were designed and arranged so that jet nozzles are disposed at positions where the circumference of a turning and crushing chamber is equally divided, and crushed material feeding nozzles are disposed one by one between each of the two equidistantly disposed jet nozzles, wherein the total number of nozzle is designed to be an odd number.

However, the abovementioned prior art jet mill has the following shortcomings and problems;

The jet mill as set forth in Publication "A" has a problem and/or a shortcoming by which, if a crushed material, for example, a new ceramic crushed material having high hardness is brought into collision with a fixing wall in line with a jet stream of a high pressure gas, the part of the fixing wall, with which the crushed material is brought into collision, is recessed by wearing, the fixing wall is damaged in a short time, and the durability thereof is remarkably impaired.

The jet mill as set forth in Publication "B" also has a problem and/or a shortcoming similar to that of Publication "A", and another problem by which, since materials are fed to the middle portion (pressure-reduced portion) of a turning air stream, crushed micro powder may be accumulated at the middle portion to worsen the screening efficiency, and the grain size distribution is remarkably widened.

In the jet mill as set forth in Publication "C", since both feeding of crushed materials and discharge of micro powder are carried out at the upper part of the turning and crushing chamber, normal streams of the turning flows which form crushing nozzles greatly fall into disorder, such disorder of the turning flows increases pressure loss, resulting in a lowering of the speed of the turning flows, whereby the crushing capacity is decreased.

In the jet mill as set forth in Publication "D", the crushing efficiency is excellent in that a collision action effected by four collision plates secured in the turning and crushing chamber is utilized. However, the speed of the turning flows of a high speed jet is lowered due to the existence of the collision plates, and the shape of crushed powder becomes square, and such a problem arises, by which it becomes difficult to adjust the grain size distribution.

Further, if the number of prior art crushed material feeding nozzles and jetting nozzles disposed is an odd number, since, after turning flows are formed by an even number of crushing nozzles, a solid and gas multi-phase flow is pressed into the turning and crushing chamber by one crushed material feeding nozzle, such a problem arises, by which segregation of turning flows due to said solid and gas multi-phase flows pressed into later on is likely to occur, and at the same time, the high pressure gas amount of the crushed material feeding nozzles and jetting nozzles must be separately established, the operation control becomes cumbersome, whereby the operation efficiency is spoiled. In addition, since the number of nozzles is an odd number, segregation is also likely to occur, wherein another problem arises, by which the crushing efficiency and screening efficiency are impaired.

In addition, since the respective jetting nozzles are provided with only one jetting port, a turning and crushing chamber is produced on the basis of flow lines of turning flows being two-dimensionally understood and analyzed as one line. Therefore, the velocity at the upper part (top liner portion) and the lower part (bottom liner portion) of the turning and crushing chamber is lowered. Accordingly, such a problem arises, by which a stay duration of large grains in the turning and crushing chamber is made longer, and the liner portions at the upper part and lower part is remarkably worn.

Further, since adjustment of the grain size of micro powder is carried out by changing only the pressure or volume of a jet stream in either type, segregation of turning flows and pressure fitting of micro powder to the inner walls of the turning and crushing chamber are liable to occur by characteristics of crushed materials, such shortcomings and/or problems arise, which causes a remarkable wearing of liner portions such as ring liners of the turning and crushing chamber, the top liner, and bottom liner, whereby continuous stabilized operation becomes impossible.

SUMMARY OF THE INVENTION

The present invention solves these shortcomings and problems described above.

It is therefore an object of the invention to provide a jet mill which remarkably improves the crushing treatment capacity and ensures continuous treatment for a longer period of time, wherein no segregation arises, high crushing efficiency and screening efficiency are obtained, micro powder having a narrow grain size distribution can be remarkably and efficiently produced, the velocity distribution of solid and gas multi-phase flows in the turning and crushing chamber can be made uniform, the collision dependency of crushed materials on the inner wall surface of the turning and crushing chamber can be lowered, the collision dependency among crushed materials can be increased, and whereby a wearing of the wall surfaces can be prevented, micro powder can be remarkably prevented from being pressure-fitted, and a stay duration in the turning and crushing chamber can be shortened.

With a jet mill according to the invention as described above, the following excellent effects can be achieved.

According to the jet mill according to a just aspect of the invention;

(1) Since a distance 1 between the venturi nozzle lead-in portion of the solid and gas blending chamber and the discharge side of the press-in nozzle is expressed in terms of $1=(D/d)\times k$, and value k is formed so that it can meet k=7 through 12, preferably, k=8 through 10 (where D is the diameter of the venturi nozzle lead-in portion, and d is the diameter of the press-in nozzle at the discharge side), both the venturi nozzles and crushing nozzles are caused to enter a standby status by the same pneumatic pressure at the same time, materials to be crushed can be sucked in regardless of types of the crushing materials, whereby continuous operation is enabled.

According to a second aspect of the invention, in addition to the effects described in the first aspect, (2) Since a negative pressure generating portion is provided between the throat portion of the venturi nozzle and the venturi nozzle lead-in portion (upstream side), the materials are sucked in from the press-in nozzle of the crushed material by high speed jet streams without leaking to the venturi nozzles, whereby it is possible to feed the materials into the turning and crushing chamber in a stable state at a high speed.

According to a third aspect of the invention, in addition to the effects described in the first and second aspects, (3) Since the respective nozzles are equidistantly disposed on the peripheral wall of the turning and crushing chamber without being biased as in the prior arts, pressure jetted from the crushing nozzles and venturi nozzles into the system is synchronized and well-balanced, no segregation of turning flows is caused to arise. Resultantly, the running operation can be facilitated, and at the same time, the dependency of crushing materials on collision with the wall surface is lowered, and the dependency on collision among grains can be increased. Therefore, a wearing of the liner portion in the turning and crushing chamber can be remarkably suppressed. In addition, since crushing materials can be prevented from being segregated in the turning and crushing chamber, the crushing efficiency is improved to increase the screening efficiency.

According to a fourth aspect of the invention, in addition to the effects described in the first, second and third aspect, (4) Turning flows in the crushing zone and screening zone in the turning and crushing chamber can be three-dimensionally controlled, the shape of grains can be made round and the grain size distribution can be narrowed. In addition, it is possible to freely control the range of grain size distribution.

(5) Since a multiple step jetting portion is employed in a multiple-row crushing nozzle, a stream line in the turning and crushing chamber is three-dimensionally obtained as multiple layers, whereby a difference in speed in the height direction in the mill is decreased to shorten the stay duration of grains in the mill, and the crushing treatment capacity can be improved.

According to a fifth aspect of the invention, in addition to the effects described in the first through fourth aspects of the invention, (6) Since the crushing nozzles are of multiple rows and the jetting angle of the respective portions are different from each other, it is possible to control the three-dimensional shape and speed of crushing and turning flows in terms of the horizontal surface and height. Since solid and gas multi-phase turning flows are three-dimensionally controlled, optimal turning flows can be formed in compliance with various types of crushed materials having different physical properties, and it is possible to adjust the grain size and to prevent micro powder from being pressure-fitted. Further, since no segregation arises, it is possible to prevent the liner portions from being worn.

(7) Since at least one of the diameters and/or jetting angles of the jetting ports of the respective rows of crushing nozzles is different from each other, the dependency on collision among materials to be crushed in turning flows can be improved, and at the same time optimal turning flows can be formed in compliance with various types of crushed materials having different physical properties.

(8) Since the diameter (calibration) of the respective jetting ports of the crushing nozzles can be changed, the diameter of the lower side jetting ports is made greater to increase the blow air volume with respect to crushing materials such as ceramic having a heavy specific gravity, and the diameter of the upper side jetting ports is made greater to increase the collision frequency among the crushing materials with respect to those having a light specific gravity such as coke and carbon for electrodes and toner, etc., whereby it is possible to obtain micro powder having a narrow grain size distribution in a short time.

(9) Since the jetting angles can be changed for each of the rows by changing only the crushing nozzles, the turning flows in the jet mill can be controlled for each of the materials to be crushed having different physical properties, whereby the turning flows suitable for the respective crushed materials can be formed.

According to a sixth aspect of the invention, in addition to the effects described in a fourth or fifth aspect,

(10) By only inserting a plug in plug insertion holes, optimal crushing conditions can be obtained in compliance with the material to be crushed.

According to a sixth aspect of the invention, in addition to the effects described in any one of the first through fifth aspects of the invention,

(11) Since the center pole on the upper surface of the turning and crushing chamber and the outlet on the underside of the turning and crushing chamber are formed on the center line of the turning and crushing chamber, it is possible to clearly divide the turning and crushing chamber into a screening zone and a crushing zone, micro powder of an appointed grain size and having a narrow grain size distribution can be discharged through the outlet at the upper part of the turning and crushing chamber, and at the same time, coarse powder can be scattered to the outer circumference by a centrifugal force generated by high speed jet streams, wherein the dependency on collision among materials in the high speed jet streams can be improved.

A jet mill of the first aspect of the invention which is a jet mill of a horizontal turning flow type is provided with a hollow disk-shaped turning and crushing chamber; a plurality ("m") of crushing nozzles, the jetting ports of which are inclined to the circumferential wall and disposed at the side wall of the turning and crushing chamber, for forming turning flows by jetting a high pressure gas; a plurality ("n") of venturi nozzles (where m+n=a, a is an integral number, and m>n) for introducing materials to be crushed, in line with high pressure gas, which are disposed at the side wall of the turning and crushing chamber; a solid and gas blending chamber, which is formed at the upstream side of said venturi nozzles; a crushed material supplying portion communicating with said solid and gas blending chamber; a press-in nozzle disposed in said solid and gas blending chamber coaxially with said venturi nozzles; and an outlet, disposed at the upper part of the center portion of said turning and crushing chamber, which discharges micro powder, wherein a distance 1 between a venturi nozzle lead-in portion of said solid and gas blending chamber and the discharge side of said press-in nozzle is expressed in terms of $1=(D/d)\times k$, a value k is formed so as to meet k=7 through 12, preferably, k=8 through 10 (where D is the diameter of the venturi nozzle lead-in portion, and d is the diameter of the press-in nozzle at the discharge side).

Thereby, a distance 1 between a venturi nozzle lead-in portion of said solid and gas blending chamber and the discharge side of said press-in nozzle is expressed in terms of $1=(D/d)\times k$, a value k is formed so as to meet k=7 through 12, preferably, k=8 through 10 (where D is the diameter of the venturi nozzle lead-in portion, and d is the diameter of the press-in nozzle at the discharge side). Therefore, both the venturi nozzles and crushing nozzles are simultaneously caused to enter a standby state at the same air pressure, and crushed materials can be smoothly sucked regardless of the kind of crushed materials, whereby continuous operation can be carried out.

Herein, the distance 1 between the venturi nozzles and press-in nozzles is a distance between the inlet of the venturi nozzle lead-in portion and the tip end portion of the press-in nozzles, which is expressed in terms of $(D/d)\times k=1$, where k is 7 through 12, preferably, 8 through 10. It is recognized that, as the k becomes smaller than 8, the sucking force of crushed materials is weakened, and as k becomes greater than 10, high pressure jet streams from the press-in nozzles completely escape from the venturi nozzles, wherein a pressure loss can be recognized. It is obtained from analysis and experimental results of a jet mill that either case is not preferable.

Iron-based, aluminum-based, copper-based, titanium-based metals and alloys or those combined with ceramics may be listed as materials for the turning and crushing chamber, crushing nozzle, press-in nozzles, and venturi nozzles. In particular, a hard alloy is preferable in view of wear resistance.

An inactive gas such as air, nitrogen, argon, etc., may be used as a high pressure gas, in compliance with the kind of materials to be crushed and crushing conditions.

A jet mill of the second aspect of the invention has such a construction where the venturi nozzles are provided with a negative pressure generating portion between a throat portion and the venturi nozzle lead-in portion.

Therefore, since the negative pressure generating portion is provided between the throat portion of the venturi nozzle and the venturi nozzle lead-in portion (upstream side) in addition to the actions obtained in the first aspect of the invention, crushed materials are sucked into the venturi nozzles by high speed jet streams from the press-in nozzles without leakage, whereby the crushed materials can be fed into the turning and crushing chamber at a high speed in a stabilized state.

Herein, the negative pressure generating pressure is formed between the throat portion of the venturi nozzles and the lead-in portion, and an inclination angle $\theta_1$ of the inlet (rear portion of the negative pressure generating portion) of the throat portion and an inclination angle $\theta_2$ of the outlet of the throat portion are expressed in terms of $0.5° \leqq \theta_1 \leqq \theta_2$, preferably $0.7° \leqq \theta_1 \leqq \theta_2$ to the axis of the venturi nozzle. In addition, $\theta_2$ is formed to 2.5° through 6°, preferably, 3° through 5°.

As the $\theta_1$ becomes smaller than 0.7°, the amount of negative pressure is decreased, and the suction is liable to become short, and as the $\theta_2$ becomes greater than 5°, similarly, the amount of negative pressure is decreased, and the suction is liable to become short. Either case is not preferable.

As $\theta_2$ becomes smaller than 3°, a pressure loss arises at the inlet of the lead-in portion, and no function of the negative pressure generating portion can be obtained, thereby causing the crushing capacity to be lowered. In addition, as $\theta_2$ becomes greater than 5°, the velocity of solid and gas multi-phase flows is lowered, thereby causing the crushing capacity to be decreased. Either case is not preferable.

The length g of the negative pressure generating portion is 2 through 4.2 times the diameter D of the venturi nozzle lead-in portion, preferably 2.2 through 3.8 times, and the length h of the throat portion is 2.25 through 5 times the diameter e of the inlet of the throat portion, preferably 3 or 4 times.

As the length g of the negative pressure generating portion becomes smaller than 2.2 times the diameter D of the venturi nozzle lead-in portion, a turning flow occurs at the lead-in portion, whereby the negative pressure for suction is likely to be decreased, and as the length g becomes greater than 3.8 times, pressure fitting at the negative pressure generating portion is likely to occur. Either case is not preferable.

As the length h of the throat portion becomes smaller than 3 times the diameter e of the inlet of the throat portion, the negative pressure is likely to be decreased by being influenced by the discharge portion, and as the length h becomes greater than four times, pressure fitting is likely to occur at the throat portion. Either case is not preferable.

A jet mill of the third aspect of the invention is constructed so that, in addition to the invention described in the first and second aspects of the invention, the total number m+n of the crushing nozzles and the venturi nozzles is an even number, and $5 \leqq m \leqq 15$, $1 \leqq n \leqq 5$, and preferably, $5 \leqq m \leqq 14$, $1 \leqq n \leqq 2$.

Therefore, since the respective nozzles are equidistantly disposed on the circumferential wall of the turning and crushing chamber without being biased as in the prior arts, in addition to the actions obtained in the first and second aspects of the invention, it is possible to synchronize pressure jetted into a system from the crushing nozzles and venturi nozzles and to secure balance, the turning flows can be freed from any segregation, resulting in an easiness of the running operations, and further, the collision dependency of materials to be crushed, on the wall surface can be decreased, and the dependency on collisions among grains is increased, whereby a wearing of the liner portions in the turning and crushing chamber can be remarkably suppressed. In addition, since crushed materials can be prevented from being segregated in the turning and crushing chamber, the crushing efficiency can be improved to heighten the screening efficiency.

Herein, as the quantity of crushing nozzles is decreased from 5, it can be recognized that controllability of the shape and speed of turning flows is likely to be impaired, and if the quantity exceeds 14, the structure of the jet mill becomes cumbersome, whereby it can be recognized that there is a tendency for the solid and gas multi-phase flows to be less controlled. Either case is not preferable.

A jet mill of the third aspect of the invention has such a construction where the respective crushing nozzles are provided with "p" steps (however, $2 \leqq p \leqq 5$) of jet portions in the vertical direction and/or "q" rows (however, $1 \leqq q \leqq 5$) of jetting portions in the cross direction.

Therefore, in addition to the actions obtained in the first through third aspects of the invention, it is possible to three-dimensionally control the turning flows in the crushing zone and the screening zone in the turning and crushing chamber, and at the same time the shape of grains can be rounded to narrow the grain size distribution, whereby such an action can be obtained, by which it is possible to freely control the range of the grain size distribution.

Since the respective crushing nozzles have multiple steps and/or multiple rows of jetting portions, the stream lines in the turning and crushing chamber can be three-dimensionally obtained as multiple step layers, and a difference in the velocity can be decreased in the height direction in the jet mill, thereby shortening the stay duration of grains in the mill. Therefore, such an action can be obtained, by which the crushing treatment capacity can be improved.

Herein, the number of steps (p) of jetting portions of crushing nozzles is $2 \leqq p \leqq 5$, preferably p=3. If the number of steps is smaller than 2, the velocity of turning flows in the vertical direction in the turning and crushing chamber is likely to become lower than that at the middle portion, and if the number exceeds 4 or the number of rows (q) of jetting portions exceeds 5 rows, the balance of the turning flows can be hardly secured, and it becomes impossible to three-dimensionally control the turning flows. Accordingly, either case is not preferable.

A jet mill as set forth in the fifth aspect of the invention has such a construction wherein, at least one of the calibrations (diameter) of the jetting ports of the respective rows and/or steps of the jetting portion and/or a jetting angle of the jetting portion is formed so as to differ from each other.

Therefore, in addition to the actions obtained by the first through fourth aspects of the invention, since at least one diameter (calibration) of jetting ports of the respective jetting portions at the respective steps of the crushing nozzles differs from each other, the shape and speed of three-dimensional crushing and turning flows of the horizontal surface and height can be controlled. By three-dimensionally controlling the solid and gas multi-phase turning flows, optimal turning flows can be formed in compliance with various types of materials to be crushed having different physical properties. Therefore, it is possible to adjust the grain size and to prevent micro powder from being pressure-fitted, and since no segregation exists, it is possible to prevent the liner portions from wearing.

In addition, since at least one of the jetting angles of the respective rows of crushing nozzles differs from each other, the collision dependency among materials to be crushed in the turning flows can be improved, and optimal turning flows can be formed in compliance with various types of crushed materials having different physical properties.

Since the diameter (calibration) of the jetting ports and jetting angles of the respective rows and steps of the crushing nozzles are clogged by a plug, etc., at the upstream side, the jetting diameter and jetting angle in response to the crushed materials can be changed, whereby the diameter of the downstream side jetting ports is made greater with respect to materials such as ceramic whose specific gravity is heavy to increase the blow volume, and in a case where the specific gravity of materials is light such as coke and carbon for electrodes and toner, etc., the diameter of the upstream side jetting ports is made greater to increase the collision frequency of crushed materials, whereby such an action can be obtained, by which micro powder having narrow grain size distribution can be obtained in a short time.

Since the jetting angle can be changed for each of the rows by only changing the crushing nozzles, it is possible to control the turning flows in the turning mill for each of the materials to be crushed, having different physical properties, and such an action can be obtained, by which turning flows suitable for the respective materials to be crushed can be formed.

Herein, since the jetting angle of the jetting portions in the respective rows of the crushing nozzles can be adjusted in a range from 20° through 80° by changing the crushing nozzles, the collision dependency among crushed materials in the turning flows can be adjusted. The diameter (calibration) of the jetting ports of the respective rows is established to be $0.3q_G \leqq q_P \leqq 2.1q_G$ where it is assumed that the blow volume of the press-in nozzles is $q_P$ and the blow volume of one crushing nozzle is $q_G$. Herein, generation of negative pressure of the venturi nozzles is decreased as $q_P$ becomes smaller than $03q_G$, wherein suction of the crushed materials is likely weakened. In addition, it is recognized that the turning flows in the jet mill are disordered as $q_P$ becomes greater than 2.1 $q_G$. Either case is not preferable.

As the jetting angle of the jetting portions in the respective rows of the crushing nozzles becomes smaller than 20°, the velocity of the crushing and turning flows is lowered, crushed materials are segregated in the turning and crushing chamber to lower the crushing efficiency. And as the jetting angle becomes greater than 80°, a wearing of the ring liners in the turning and crushing chamber is increased. Either case is not preferable.

Further, in order to secure universality of the crushing nozzles, jetting angles of the jetting portions in the respective row, 22.5° (for crushed materials which are likely to be segregated or are difficult to be separated), 45° (for crushed materials, whose hardness is high, causing the liner portions to be easily worn),and 67.5° (for materials having a pressure-fitting characteristic) are combined, whereby it is possible to efficiently crush materials from a high specific gravity and a small specific gravity.

A jet mill of a sixth aspect of the invention has such a construction where the jetting portions of the crushing nozzles have a plug inserting hole formed at the upstream side.

Therefore, in addition to the action obtained by any one of fourth and fifth aspects of the invention, such an action can be obtained, by which the crushing conditions best suitable for materials to be crushed can be obtained by only inserting a plug in the plug inserting hole.

It is preferable that a plug used herein may be made of metal, synthetic resin, etc.

A jet mill of a seventh aspect of the invention is provided with a center pole disposed at the middle of the underside of said turning and crushing chamber, in addition to the construction described in the first through sixth aspects of the invention, wherein the top point of the center pole and the lower end face of the outlet are located on the center line in the height direction of the turning and crushing chamber.

Therefore, in addition to the actions described in the first through sixth aspects of the invention, the turning and crushing chamber can be clearly divided into a screening zone and a crushing zone by forming the center pole on the upper surface of the turning and crushing chamber and outlet on the under surface of the turning and crushing chamber so that they are disposed on the center line of the turning and crushing chamber, whereby micro powder of an appointed grain size and that having narrow grain size distribution can be discharged through the outlet on the upper part of the turning and crushing chamber, and at the same time, coarse grains are scattered to the outer circumference by a centrifugal force generated by high jet streams, and collision dependency among materials in the high speed jet streams can be improved.

Herein, iron-based, aluminum-based, copper-based, titanium-based metals or alloys or those combined with ceramic may be listed as materials of the outlet and center pole. In particular, a hard alloy is preferable in terms of wear resistance.

BRIEF DESCRIPTION OF THE DRAWINGS

In the accompanying drawings:

FIG. 9(*b*) is a bottom view of the assembled crushing nozzle body;

FIG. 9(*c*) is a front elevational view of the assembled crushing nozzle view; and FIG. 9(*d*) is a sectional view of major parts of an insertion type jetting portion of the assembled crushing nozzle;

PREFERRED EMBODIMENTS OF THE INVENTION

Hereinafter, a description is given of the preferred embodiments of the invention with reference to the drawings.

(Embodiment 1)

A jet mill according to a first preferred embodiment of the invention is described with the accompanying drawings.

Figure 1:
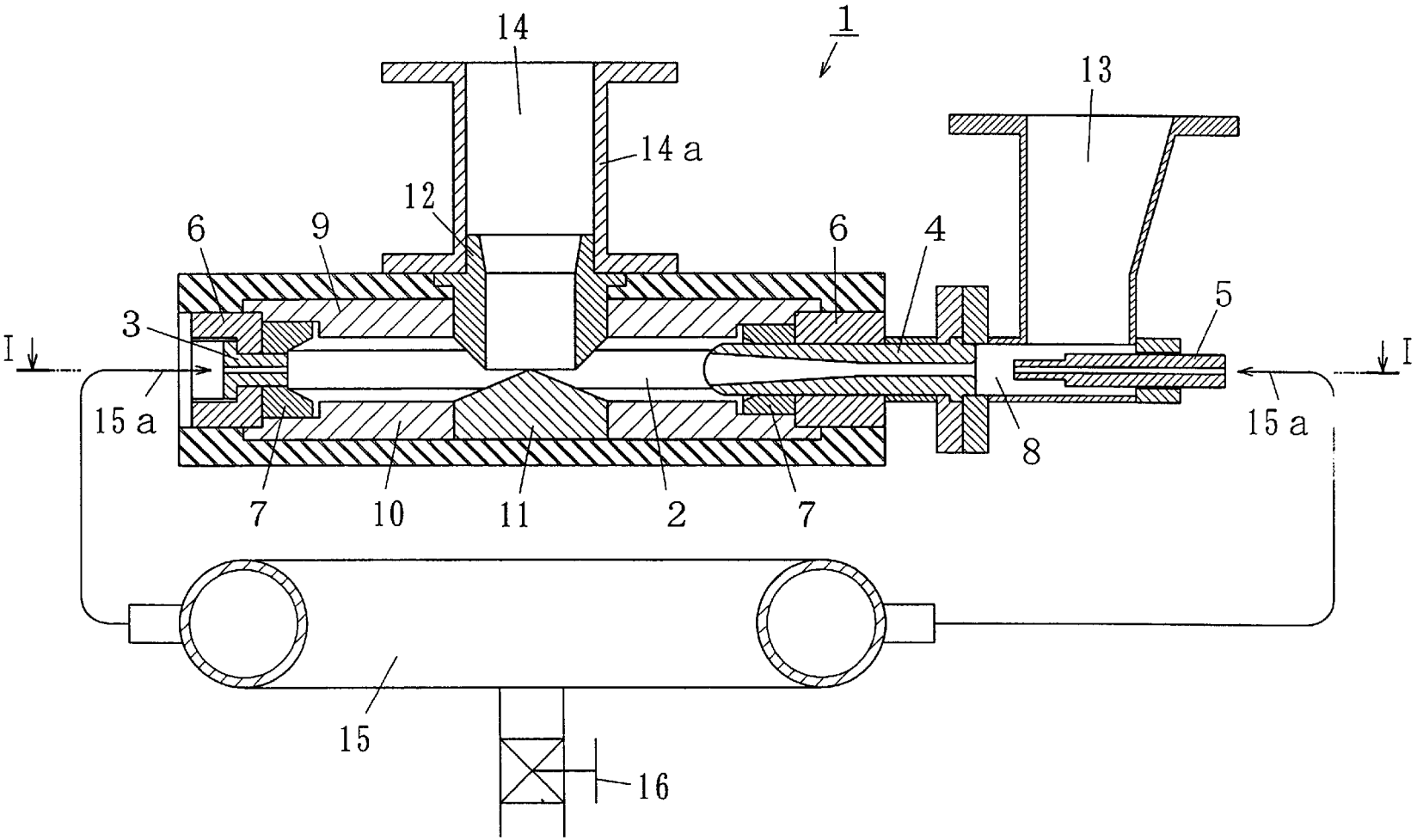
FIG. 1 is a sectional view of major parts of a jet mill according to the first preferred embodiment of the invention.
Figure 2:
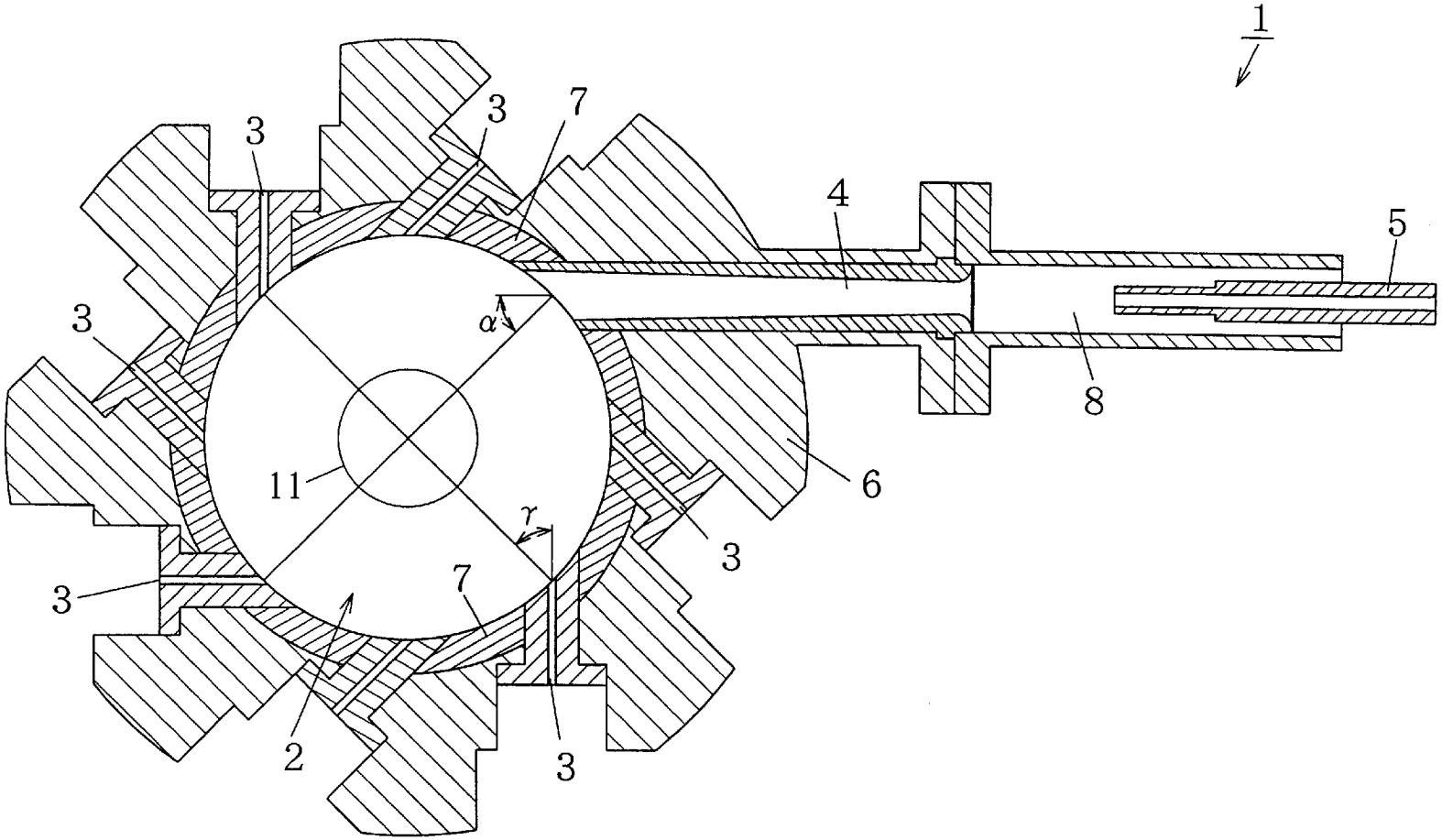
FIG. 2 is a ross-sectional view of major parts, taken along the line I—I in FIG. 1.
Figure 3:
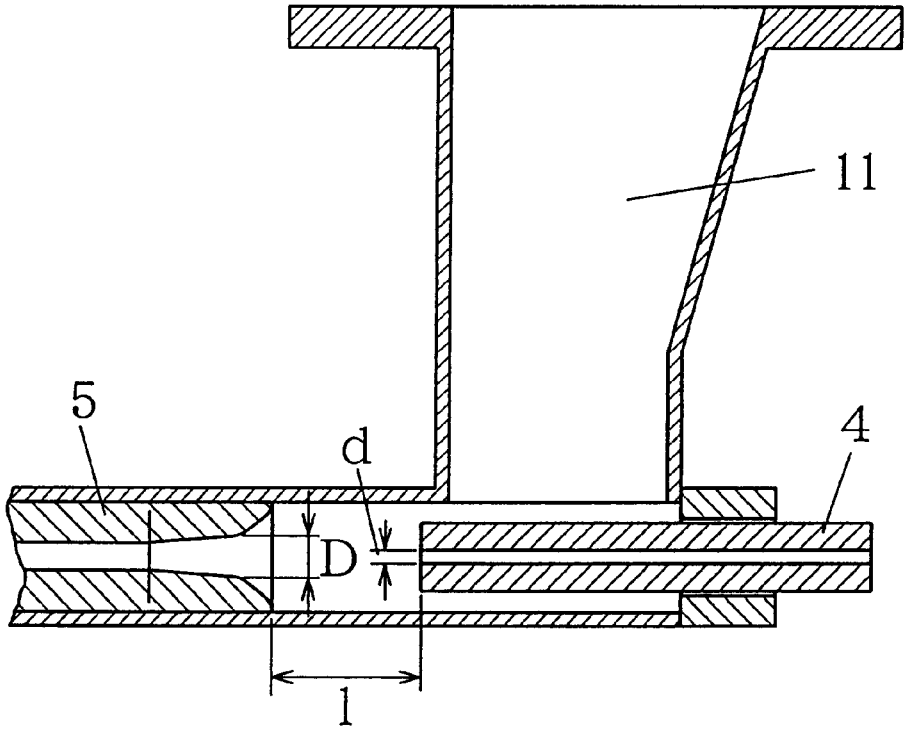
FIG. 3 is a sectional view of major parts of a solid and gas blending chamber of the jet mill according to the first preferred embodiment of the invention.
Figure 4:
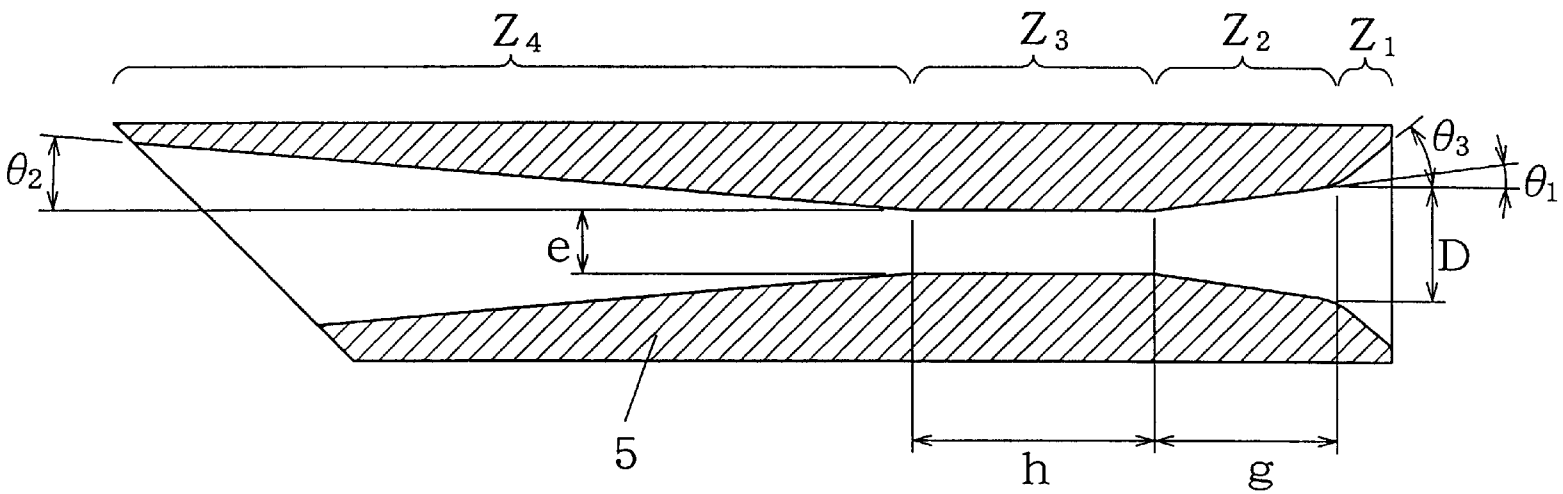
FIG. 4 is a sectional view of major parts of a venturi nozzle of the jet mill according to the first preferred embodiment of the invention.

FIG. 1 is a sectional view of major parts of a jet mill according to the first preferred embodiment of the invention, FIG. 2 is a cross-sectional view of major parts, taken along the line I—I in FIG. 1, FIG. 3 is a sectional view of major parts of a solid and gas blending chamber in a jet mill according to the first preferred embodiment of the invention. FIG. 4 is a sectional view of major parts of venturi nozzles of a jet mill according to the first preferred embodiment.

In FIG. 1, a jet mill according to the first preferred embodiment is indicated by 1. A turning and crushing chamber 2 is formed hollow and disk-shaped, seven crushing nozzles 3 are equidistantly disposed in the turning and crushing chamber 2, a venturi nozzle 4 is disposed in the turning and crushing chamber 2, a press-in nozzle 5 is disposed coaxially with the venturi nozzle 4 via a solid and gas blending chamber 8 at the upstream side of the venturi nozzle 4, a body casing is indicated by 6, a ring liner of the turning and crushing chamber 2 is indicated by 7, a solid and gas blending chamber is indicated by 8, a top liner 9 and a bottom liner 10 are disposed perpendicularly in the turning and crushing chamber 2, a center pole 11 is such that its upper part detachably disposed at the middle of the bottom liner 10 is formed to be roughly conical, an outlet 12 is formed coaxially with the center pole 11 and is detachably disposed at the top liner 9, a crushing material lead-in port 13 communicates with the solid and gas blending chamber 8, a micro powder discharge port 14 is formed by a sleeve 14*a*, a high pressure header tube is indicated by 15, a high pressure gas pipe 15*a* feeds a high pressure gas from the high pressure header tube 15 to the crushing nozzles 3 and press-in nozzles 5, and a pressure adjusting valve 16 adjusts pressure of the high pressure gas pipe 15*a*.

In FIG. 2, $\alpha$ is a jetting angle of the venturi nozzles, and $\gamma$ is a jetting angle of the jetting portions of the crushing nozzles. $\alpha$ is adjusted to 20° through 70°, preferably 30° through 50°. As $\alpha$ becomes smaller than 30°, such a tendency arises, where resistance occurs in suction of multi-phase flows and turning flows are disordered, and as a becomes greater than 50°, such a tendency arises, where pressure fitting and wearing are likely to occur at the liner portions. Either case is not preferable. $\gamma$ differs in compliance with the number of crushing nozzles and type of materials to be crushed.

In FIG. 3, D is an inlet diameter of the upstream side opening of the venturi nozzles 4, d is an outlet diameter of the press-in nozzles 5, 1 means a distance between the lead-in portion of the venturi nozzles 4, and the discharge side of the press-in nozzles 5.

As regards the distance 1 between the lead-in portion of the venturi nozzle 4 of the solid and gas blending chamber 8 and the discharge side end of the press-in nozzle 5, the position of the press-in nozzle 5 is determined so as to meet an expression of $1=(D/d)\times k$, wherein the value k is a value obtained through experiments, and k=7 through 12, preferably, a value of 8 through 10 is employed.

In FIG. 4, $\theta_1$ is an inclination angle of the inlet (the rear portion of the negative pressure generating portion $Z_2$) of the throat portion $Z_3$ with respect to the axial line of the venturi nozzle, $\theta_2$ is an inclination angle of the outlet of the throat portion $Z_3$ of the venturi nozzles, $\theta_3$ is an inclination angle of the lead-in portion $Z_1$ of the venturi nozzle, $Z_1$ is the lead-in portion of the solid and gas multi-phase flows, which is greatly open to the upstream side of the venturi nozzles, $Z_2$ is a negative pressure generating portion slightly inclined and formed with respect to the axial line from the lead-in portion end, $Z_3$ is a throat portion formed roughly parallel to the axial line, $Z_4$ is a discharge portion open from the rear portion of the throat portion $Z_3$, e is a diameter of the inlet of the throat portion $Z_3$, h is a length of the throat portion $Z_3$, and g is a length of the negative pressure generating portion $Z_2$.

The inclination angle $\theta_1$ of the inlet portion (the rear portion of the negative pressure generating portion) of the throat portion $Z_3$ and the inclination angle $\theta_2$ of the outlet of the throat portion $Z_3$ is formed to be $0.5° \leqq \theta_1 \theta_2$, preferably $0.70 \leqq \theta_1 \leqq \theta_2$ with respect to the axial line of the venturi nozzle. In addition, $\theta_2$ is formed to be 2.5° through 6°, preferably, 3° through 5°. The length g of the negative pressure generating portion $Z_2$ is 2 through 4.2 times the diameter D of the venturi nozzle lead-in portion, preferably 2.2 through 3.8 times, and the length h of the throat portion $Z_3$ is 2.25 through 5 times the diameter e of the inlet of the throat portion $Z_3$, preferably 3 through 4 times.

With the jet mill according to the first preferred embodiment constructed as described above, a description is given of the actions thereof.

A high pressure gas is supplied to both the crushing nozzle 3 and press-in nozzle 5 at the same pressure by opening one pressure adjusting valve 16. A material to be crushed is supplied through the material lead-in portion 13, whereby the material and air are blended in the solid and gas blending chamber 8 by high speed jet streams jetted from the press-in nozzle 5. The distance 1 between the venturi nozzle 4 and the press-in nozzle 5 is $(D\times d)\times k - 1$, wherein by meeting the relation of k=7 through 12, preferably 8 through 10, the multi-phase flow from the venturi nozzle 4 is well stabilized and is introduced from the venturi nozzle 4 into the turning and crushing chamber 2 at a high speed since no pressure loss is generated at the outlet of the turning and crushing chamber 2 and venturi nozzle 4. Turning flows are generated in the turning and crushing chamber 2 by high speed jet streams from the crushing nozzle 3, and a crushing zone is formed at the outer circumference of the turning and crushing chamber 2, whereby a screening zone is formed at the middle of the turning and crushing chamber 2. Therefore, materials to be crushed are brought into collision with each other by a high speed jet and turning streams, whereby micro crushing of materials is carried out. Micro powder screened by the screening zone is discharged from an outlet 12 of the turning and crushing chamber through a micro powder discharge port 14, and coarse powder is swiveled to the outer circumference by a centrifugal force produced by turning, whereby the coarse powder is brought into collision with each other, and crushing is repeatedly carried out.

The velocity of the solid and gas multi-phase flows introduced from the lead-in portion is increased and is jetted into the turning and crushing chamber by the negative pressure generating portion of the venturi nozzles. In addition, the lead-in portion of the press-in nozzles and venturi nozzles are maintained at an appointed distance, and at the same time, since the solid and gas multi-phase flows are jetted into the turning and crushing chamber without impairing the blow volume and blow pressure of the press-in nozzles by providing the negative pressure generating portion, the balance of the turning flows is well controlled without being collapsed.

With the first preferred embodiment described above, smooth solid and gas multi-phase flows of the venturi nozzle can be achieved, high crushing efficiency and screening efficiency are resultantly enabled without generating any segregation, and micro powder having narrow grain size distribution can be obtained at a remarkably high efficiency. Further, it is possible to make the velocity distribution of the multi-phase flows uniform in the turning and crushing chamber. Therefore, it is possible to provide a jet mill in which the stay duration of materials to be crushed in the turning and crushing chamber can be shortened, and the crushing treatment capacity of which is remarkably improved.

(Embodiment 2)

A description is given of a second preferred embodiment of the invention with the accompanying drawings.

Figure 5:
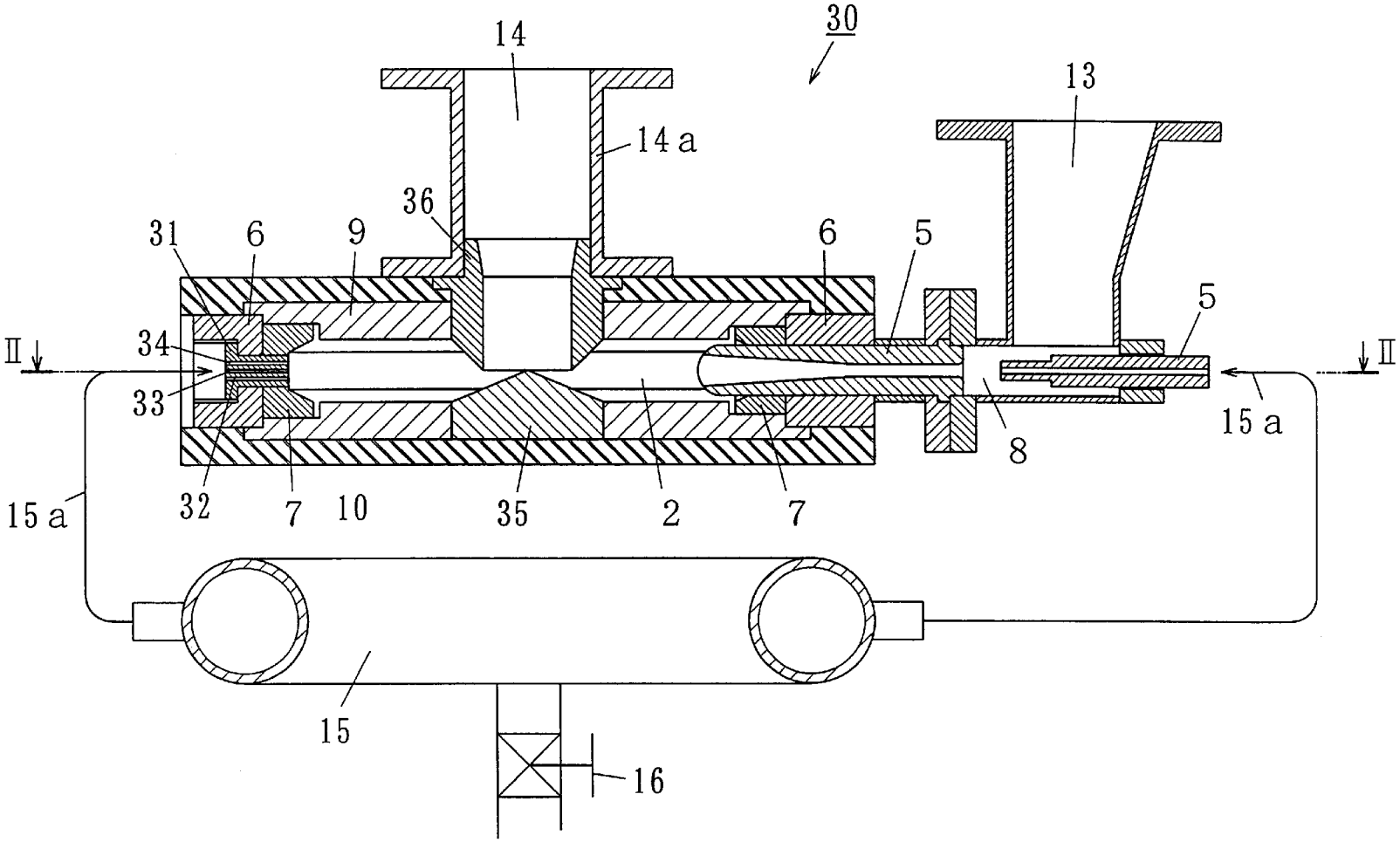
FIG. 5 is a sectional view of major parts of the jet mill according to the second preferred embodiment of the invention.
Figure 6:
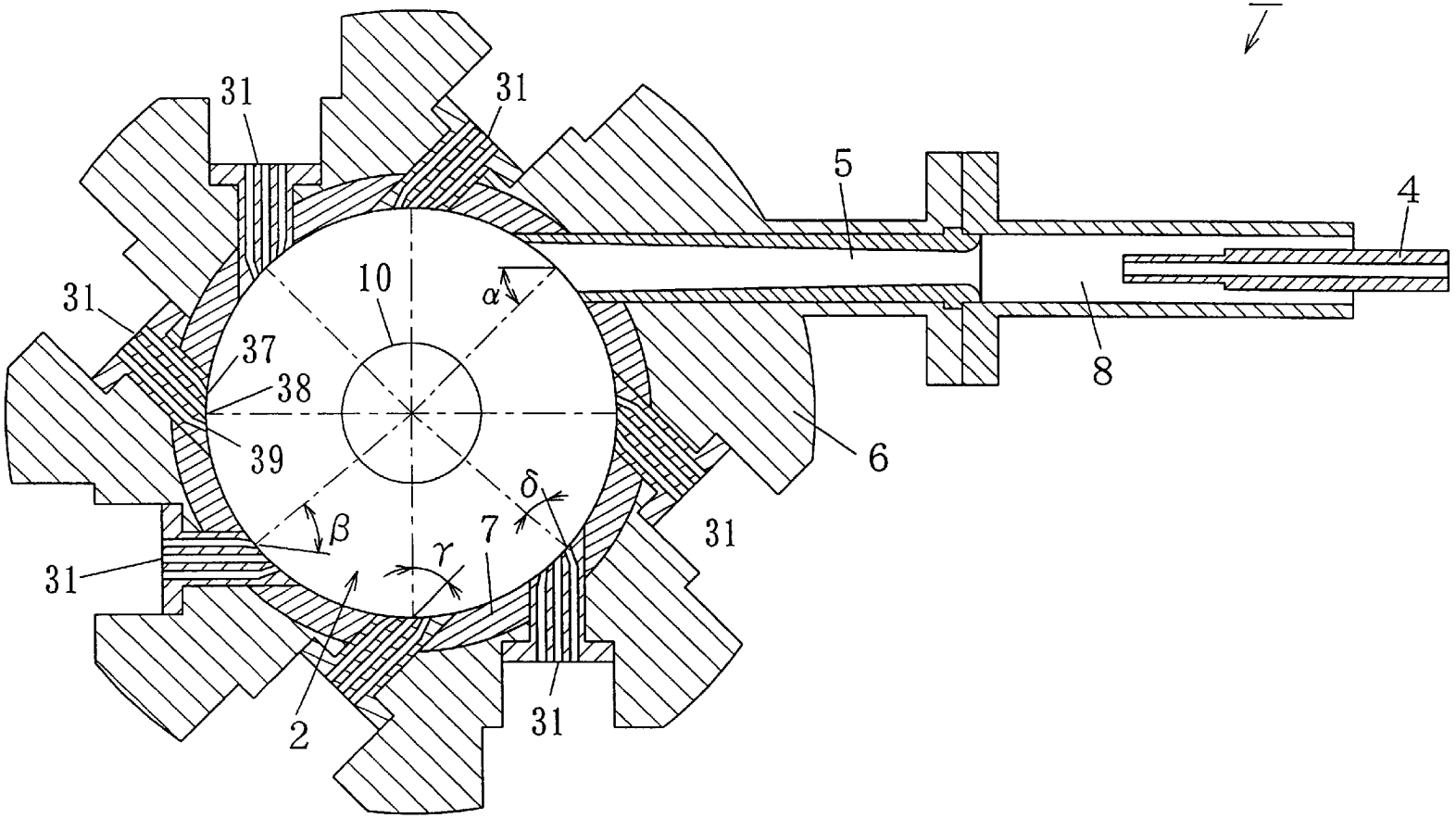
FIG. 6 is a cross-sectional view of major parts taken along the line II—II in FIG. 5, FIG. 7(*a*) is a perspective view of the rear side of a crushing nozzle according to the second preferred embodiment of the invention, FIG. 7(*b*) is a bottom view of the crushing nozzle, and FIG. 7(*c*) is a cross-sectional view of major parts, taken along the line III—III in FIG. 7(*b*)
Figure 7:
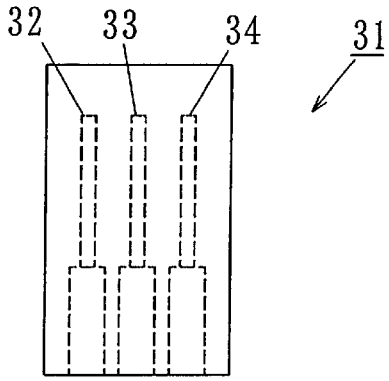
Figure 7:
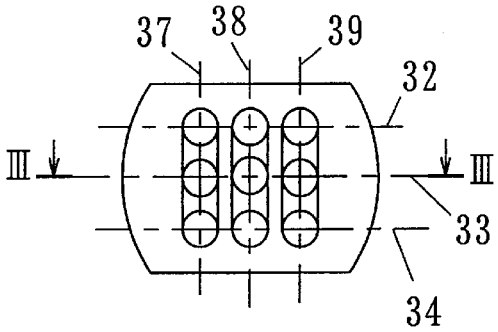
Figure 7:
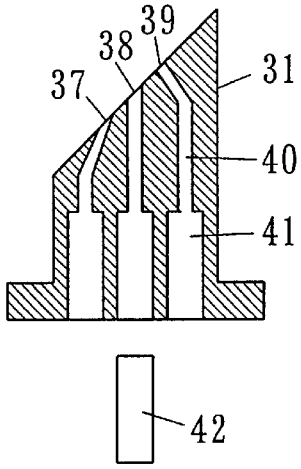

FIG. 5 is a sectional view of major parts of a jet mill according to the second preferred embodiment of the invention, FIG. 6 is a cross-sectional view of major parts, taken along the line II—II in FIG. 5, FIG. 7(*a*) is a perspective view of the rear side of a crushing nozzle according to the second preferred embodiment of the invention, FIG. 7(*b*) is a bottom view of the crushing nozzle, and FIG. 7(*c*) is a cross-sectional view of major parts, taken along the line III—III in FIG. 7(*b*). In addition, parts which are identical to those in the first preferred embodiment are given the same reference numbers, and description thereof is omitted.

FIG. 5, a jet mill according to the second preferred embodiment is indicated by 30, a complex jetting nozzle 31 is formed so that the jetting ports are nine in total, which are provided three steps in the vertical direction and three rows in the horizontal direction, and seven complex jetting nozzles 31 are equidistantly disposed in the turning and crushing chamber 2. Jetting portions 32, 33, and 34 are, respectively, provided with the upper, middle and lower steps of the complex jetting nozzle 31, and a center pole is indicated by 35 and an outlet is indicated by 36.

In FIG. 6, a jetting port 37 of the crushing nozzle of the first row is formed so that the jetting angle $\beta$ is 67.5°. A jetting port 38 of the crushing nozzle of the second row is formed so that the jetting angle $\gamma$ is 45°. A jetting port 39 of the crushing nozzle of the third row is formed so that the jetting angle $\delta$ is 22.5°. $\alpha$ is a jetting angle of the venturi nozzle.

In FIG. 7, a jetting portion of the complex jetting nozzle 31 is indicated by 40, and a plug inserting hole 41 is provided so as to widen and open at the base portion of the jetting portion 40 of the complex jetting nozzle 31 and inserts a plug 42 in compliance with the type and treatment conditions of materials to be crushed. The plug is indicated by 42.

As regards a jet mill according to the second preferred embodiment, which is constructed as described above, a description is given of actions thereof.

Seven complex crushing nozzles 31 are installed at appointed positions and angles at the ring liner 7 of the turning and crushing chamber 2, wherein nine jetting ports which are provided with three steps by three rows are formed in one complex crushing nozzle 31. The upper step jetting portion 32 is caused to control the upper layer of the jet mill 30 in the height direction, the middle jetting portion 33 is caused to control the middle layer of the jet mill 30 in the height direction, and the lower step jetting portion 34 is caused to control the lower layer of the jet mill 30 in the height direction, whereby it is possible to three-dimensionally control the shape of crushing and turning flows and velocity. By adjusting the jetting angle $\beta$ of the first row jetting port 37 of the complex crushing nozzle 31 in a range from 50° through 80°, it is possible to control the collision dependency of materials to be crushed with the ring liner 7 of the turning and crushing chamber. By adjusting the jetting angle $\gamma$ of the second row jetting port 38 of the complex crushing nozzle 31 in a range from 30° through 60°, it is possible to control the collision dependency among materials to be crushed in turning flows. By adjusting the jetting angle $\delta$ of the third row jetting port 39 of the complex crushing nozzle 31 in a range from 20° through 50°, it is possible to control the stay duration of the materials in the jet mill. Turning flows are generated in the turning and crushing chamber 2 by high speed jet streams from the respective jetting ports of the complex crushing nozzles 31, and a crushing zone is formed on the inner circumferential side of the turning and crushing chamber 2, whereby a screening zone is formed at the middle side of the turning and crushing chamber 2. Materials are brought into collision with each other by the high speed jets and turning flows, and crushing of the materials is carried out. Micro powder screened by the screening zone is discharged from the outlet 36 of the turning and crushing chamber through the micro powder discharge port 14*a*, and coarse powder is turned to the outer circumference by a centrifugal force generated by turning, whereby the materials to be crushed are colliding with each other, and crushing is repeatedly carried out.

Further, by inserting the plug 42 into the insertion hole 40, the jetting angle and number of jetting ports of the jetting portion are controlled to form turning flows suitable for various types of powder.

Next, a description is given of situations of turning flows in a case where the jetting portion of crushing nozzles is formed of one row, and the diameter of the jetting portion of the respective jetting portion is changed.

Figure 8:
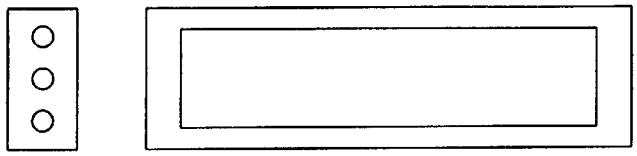
FIGS. 8(*a*)–8(*g*) are exemplary views showing a relationship between the diameter of jetting ports of one row and turning flows of a complex crushing nozzle according to the invention.
Figure 8:
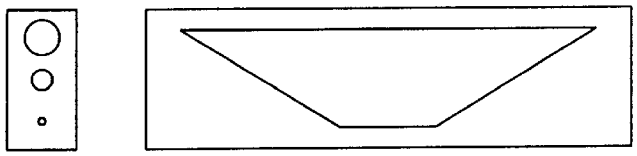
Figure 8:
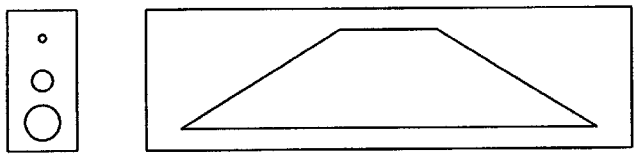
Figure 8:
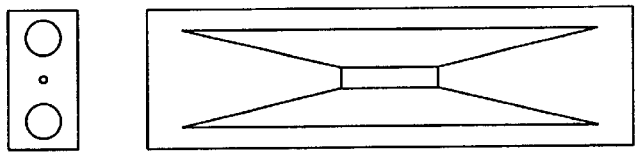
Figure 8:
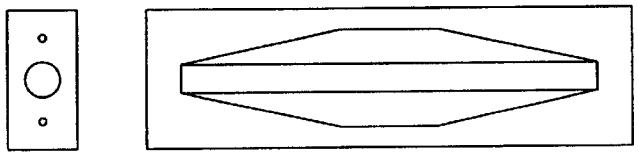
Figure 8:
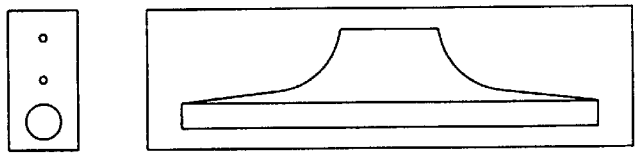
Figure 8:
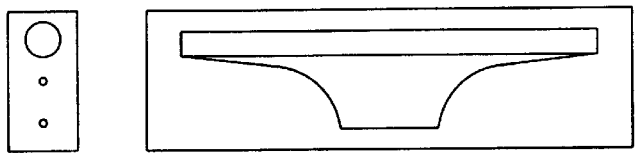

FIG. 8 is an exemplary view showing a relationship between the diameter of jetting ports of one row of the complex crushing nozzle and turning flows.

In FIG. 8, it is found that turning flows suitable for materials to be crushed can be obtained, by changing the diameter of jetting ports of one row of the crushing nozzles 31 in the respective steps.

In the case of a, since turning flows are uniformly formed on the entire layer, it is possible to crush various types of materials to be crushed, at a high efficiency.

In the case of b, since a great deal of blowair can be obtained, it is suitable for materials having a light specific gravity such as toner, carbon, etc.

In the case of c, since a great deal of blow air is given to the lower layer, it is suitable for materials having a heavy specific gravity such as fine ceramic, etc.

In the case of d, this is suitable for blended materials of powder having several different specific gravities.

In the case of e, this is suitable for crushing of various types of materials to be crushed, by utilizing only a small driving force.

In the case of f, this is suitable for materials to be crushed, having a heavy specific gravity, and the dispersion characteristics of which are not good.

In the case of g, this is suitable for materials to be crushed, of fragile powder, having a light specific gravity.

Herein, it is found through confirmation tests that the diameter ratio for large, medium and small diameters is a:b:c=a:1.5 through 3a:3 through 6a where a is a small diameter, b is a medium diameter and c is a large diameter.

Next, a description is given of a modified version of the second preferred embodiment with reference to the accompanying drawings.

Figure 9:
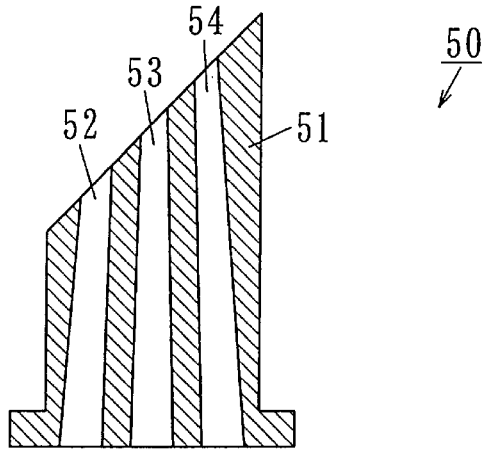
FIG. 9(*a*) is a sectional view of major parts of an assembled crushing nozzle body according to the second preferred embodiment of the invention.
Figure 9:
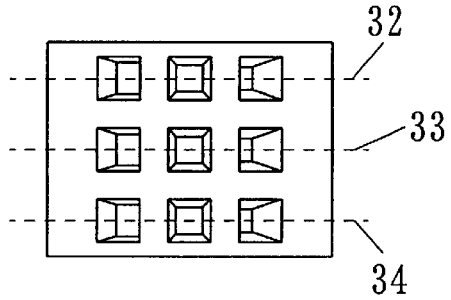
Figure 9:
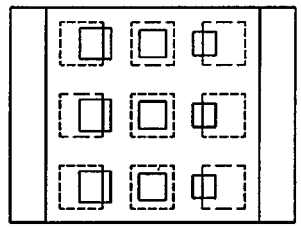
Figure 9:
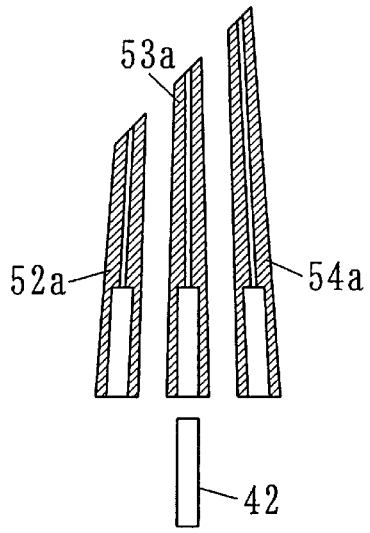

FIG. 9(*a*) is a sectional view of the major parts of an assembled crushing nozzle body of the second preferred embodiment of the invention, FIG. 9(*b*) is a bottom view of the assembled crushing nozzle body, FIG. 9(*c*) is a front elevational view of the assembled crushing nozzle body, and FIG. 9(*d*) is a sectional view of the major parts of an insertion type jetting portion of the assembled crushing nozzle.

In FIG. 9, an assembled crushing nozzle 50 is provided with insertion holes of an insertion type jetting portion, the respective rows of which are penetrated at different angles in the axial direction of the nozzle body in a modified version of the second preferred embodiment of the invention, the body of the assembled crushing nozzle is indicated by 51. Insertion holes 52, 53, and 54 are, respectively, formed to be square, into which the first, second and third insertion type jetting portions are inserted. The insertion holes 52 and 54 are provided so as to be inclined with respect to the axial direction of the body 51 so that an appointed jetting angle (for example, 22.5°, 67.5°) can be obtained when the assembled crushing nozzle 50 is inserted into the turning and crushing chamber. Insertion type jetting portions 52, 53*a* and 54 are, respectively, inserted into the respective insertion holes 52, 53 and 54 of the respective rows. A plug 42 is inserted, as necessary, into a plug insertion hole which is formed at the upstream side of the insertion holes 52, 53 and 54.

As regards the assembled crushing nozzle according to the modified version of the second preferred embodiment constructed as described above, a description is given of the actions thereof.

The diameter and/or jetting angle of the jetting ports at the respective rows 52, 53 and 54 and/or the respective steps 32, 33 and 34 of the assembled crushing nozzle 50 may be obtained by adequately selecting and inserting the optimal insertion type jetting portions 52, 53*a* and 54*a* in compliance with the type of materials to be crushed and crushing conditions, whereby the optimal turning flows can be obtained in compliance with the materials to be crushed. Since the insertion holes are formed to be square, the jetting portions do not slip even though a high pressure gas is introduced, and an appointed position and angle can be secured.

Also, although the insertion holes 52 and 54 are inclined in the axial direction of the nozzle body 51 and drilled so that an appointed jetting angle can be obtained, the insertion holes 52 and 54 are secured in parallel to the axial direction of the nozzle body 51, and the jetting holes of the insertion type jetting portions 52*a* and 54*a* may be inclined and formed at an appointed angle with respect to the axial direction of the body 51.

As described above, according to the second preferred embodiment, in addition to the actions obtained by the first preferred embodiment, such a horizontal turning flow type jet mill can be provided, by which it is possible to three-dimensionally control the turning flows of a crushing zone and a screening zone in the turning and crushing chamber by adjusting the jetting angle $\alpha$ of the venturi nozzles, and jetting angles $\beta$, $\gamma$ and $\delta$ of the jetting portions of the complex crushing nozzle and providing one complex crushing nozzle with jetting ports consisting of at least one row and at least one step, and at the same time making it possible to adjust the grain size and to prevent micro powder from being pressure-fitted, wherein no segregation of crushed materials arises in the turning and crushing chamber, and further, a wearing of the ring portion and the top and bottom liners can be suppressed to the minimum while making grains round and narrowing the grain size distribution, and in addition, it is possible to freely control the range of grain size distribution.

Further, although a description was given of an example in which seven crushing nozzles excluding a venturi nozzle are, respectively, provided at eight equally divided positions of the circumference of the turning and crushing chamber 2 at appointed angles, the invention may be applicable to cases where the crushing nozzles may be provided at other equally divided positions.

In addition, although the description was given of three rows, the number of rows may be one or another plural value.

A description is given of detailed modes on the embodiments of the invention.

(Mode 1)

A crushing test of a $V_2O_5$ catalyst was carried out by using a jet mill according to the first embodiment.

(1) Size and Structure of the Jet Mill

A turning and crushing chamber whose inner diameter is adjusted to 400 mm and a height of 70 mm was used.

Seven crushing nozzles, in which the diameter of the jetting port of the nozzle is 3.4 mm, and one venturi nozzle were used. The nozzles were disposed at eight equally divided positions of the peripheral wall of the turning and crushing chamber.

(2) Material to Be Crushed $V_2O_5$ catalyst was used, $X_{50}$=15 $\mu$m.

(3) Crushing Conditions

The pneumatic pressure of the press-in nozzle and crushing nozzles was 7 kgf/cm$^2$, the amount of introduction of the crushed material was 60 kg per hour, and continuous operation was 72 hours.

Under the above conditions, a crushing test of a $V_2O_5$ catalyst was carried out. After the operation was over, the jet mill was disassembled to measure the $V_2O_5$ catalyst pressure-fit layer on the ring liner in the turning and crushing chamber. As a result, the maximum pressure fitted layer was 3.7 mm thick.

(COMPARATIVE EXAMPLE 1)

In the comparative example 1, a crushing test of a $V_2O_5$ catalyst was carried out by a prior art jet mill.

(1) Size and Structure of the Jet Mill

The size of the turning and crushing chamber of the comparative example 1 was the same as that of mode 1. Further, the crushing nozzles and venturi nozzles were the same as those of mode 1. Eight crushing nozzles were disposed at eight equally divided positions on the peripheral wall of the turning and crushing chamber, and one venturi nozzle was disposed between two crushing nozzles.

(2) Material to Be Crushed

The material which is the same as that in mode 1 was used.

(3) Crushing Conditions

The crushing test was carried out under the same conditions as those of mode 1.

After the operation was over, the jet mill was disassembled to measure the pressure-fitting layer of the $V_2O_5$ catalyst of the ring liner in the turning and crushing chamber. As a result, the maximum pressure fitting layer was 12 mm thick.

As has been made clear from a difference in thickness of the maximum pressure fitting layer between mode 1 and the comparative example 1, in comparing the jet mill according to mode 1 with the prior art jet mill, it was found that the thickness of the maximum pressure fitting layer of the $V_2O_5$ catalyst on the ring liner in the jet mill after it was operated for 72 hours was only 31% that of the comparative example 1.

As described above, according to mode 1 of the first preferred embodiment, it is understood that materials to be crushed are brought into collision with each other by a high speed jet in the turning and crushing chamber, thereby improving the crushing efficiency. In addition, the shape of grains was made round. Based on the above, it was understood that high quality micro powder could be obtained.

(Mode 2)

A crushing test of a $V_2O_5$ catalyst was carried out by using a jet mill according to the second preferred embodiment.

(1) Size and Structure of the Jet Mill

The size of the turning and crushing chamber which is the same as that of mode 1 was used.

Seven complex crushing nozzles, each consisting of three jetting ports (diameter is 2.0 mm) per row, were used and nozzles were disposed at eight equally divided positions at the peripheral wall of the turning and crushing chamber. One venturi nozzle was used.

Materials to be crushed (2) and crushing conditions (3) are the same as those in mode 1.

As regards the evaluation, crushed micro powder was measured by a laser grain distribution meter in connection with the grain distribution and grain size. The result was illustrated in FIG. 10 which is a view showing a relationship between the grain size of micro powder and grain size accumulation (%) of the crushed micro powder.

(COMPARATIVE EXAMPLE 2)

Figure 10:
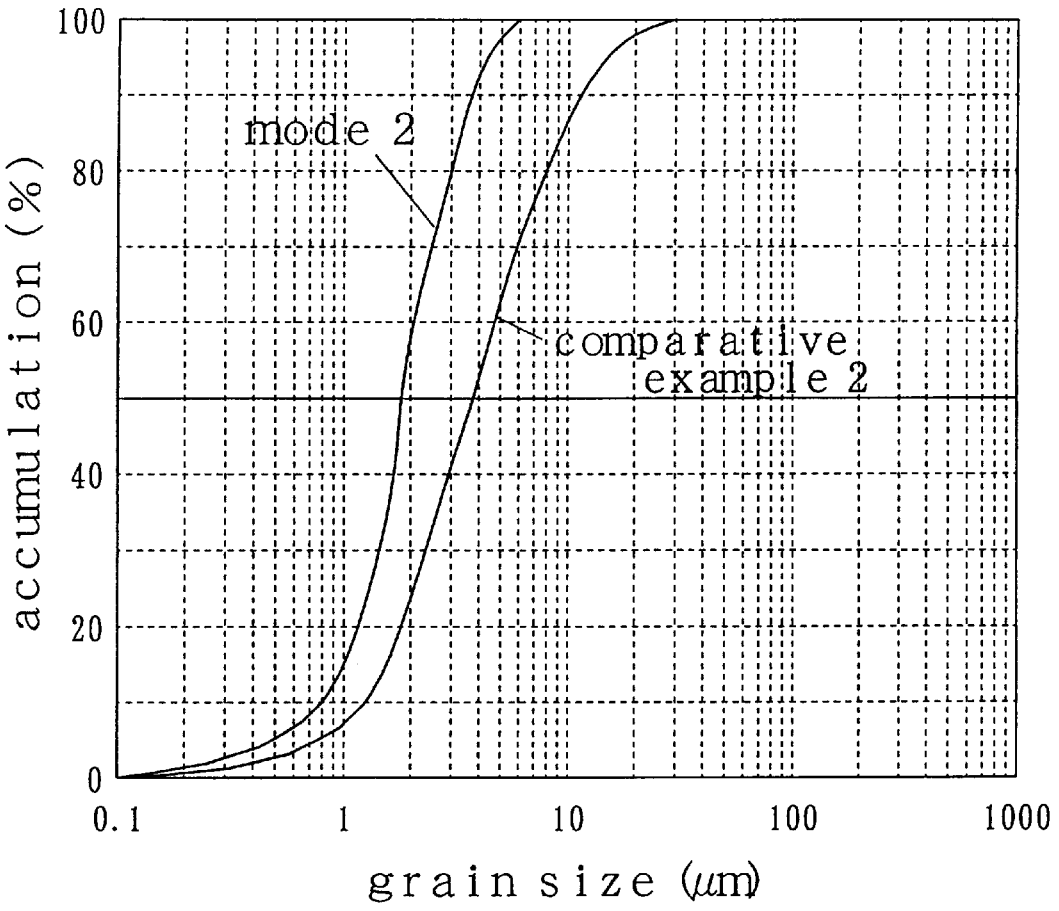
FIG. 10 is a view showing a relationship between the grain size and grain size accumulation (%) of micro powder crushed by second preferred embodiment according to the invention and comparative example 2.

The jet mill used for the comparative example 1 was also used for the comparative example 2, the test was carried out under the same conditions in mode 2. Next, an evaluation was also carried out under the same conditions in mode 2. FIG. 10 shows the results of the evaluation.

As has been made clear in FIG. 10, it was found that the maximum grain size of the comparative example 2 was 32.0 $\mu$m while the maximum grain size of the micro powder crushed in mode 2 was 6.0 $\mu$m and that the grain size distribution range in mode 2 was only 18% that of the comparative example 2. This is because the materials to be crushed were brought into contact with each other to improve the crushing efficiency by a high speed jet in the turning and crushing chamber in mode 2, whereby no segregation arises in the turning and crushing chamber to also improve the crushing efficiency, the grain size distribution, as micro powder accuracy, was made narrow, and further, the grain size distribution range could be adjusted.

Further, it was found that the grain size $X_{50}$ of the comparative example 2 was 3.82 $\mu$m while the grain size $X_{50}$ of mode 2 was 1.82 $\mu$m. Since the grain size $X_{50}$ of mode 2 was only 47% the grain size $X_{50}$ of the comparative example 2, it was found that the grain size distribution $X_{50}$ of mode 2 is remarkably narrow.

In addition, after the experiment was finished, the jet mill used for mode 2 was disassembled, and the interior of the turning and crushing chamber was checked, wherein no pressure fitting situation of micro powder could be found. To the contrary, as regards the comparative example 2, pressure fitting could be found as in the comparative example 1. Judging from the above, it is understood that no segregation arose in mode 2, and the turning flows were well-balanced and controlled.

(Mode 3)

The jet mill used for mode 2 was further used for mode 3, and dependency on the grain size distribution of materials to be crushed was checked with respect to pressure of a high speed jet stream.

(1) Tests were carried out at pressure of 7.5 kgf/cm$^2$ (a) and 4.5 kgf/cm$^2$ (b) of the high speed jet stream.

(2) Materials to be crushed, and amount of introduction

Epoxi-based resin ($X_{50}$=50$\mu$m) was used, and the amount of introduction was 10 kg per hour in each case.

Figure 11:
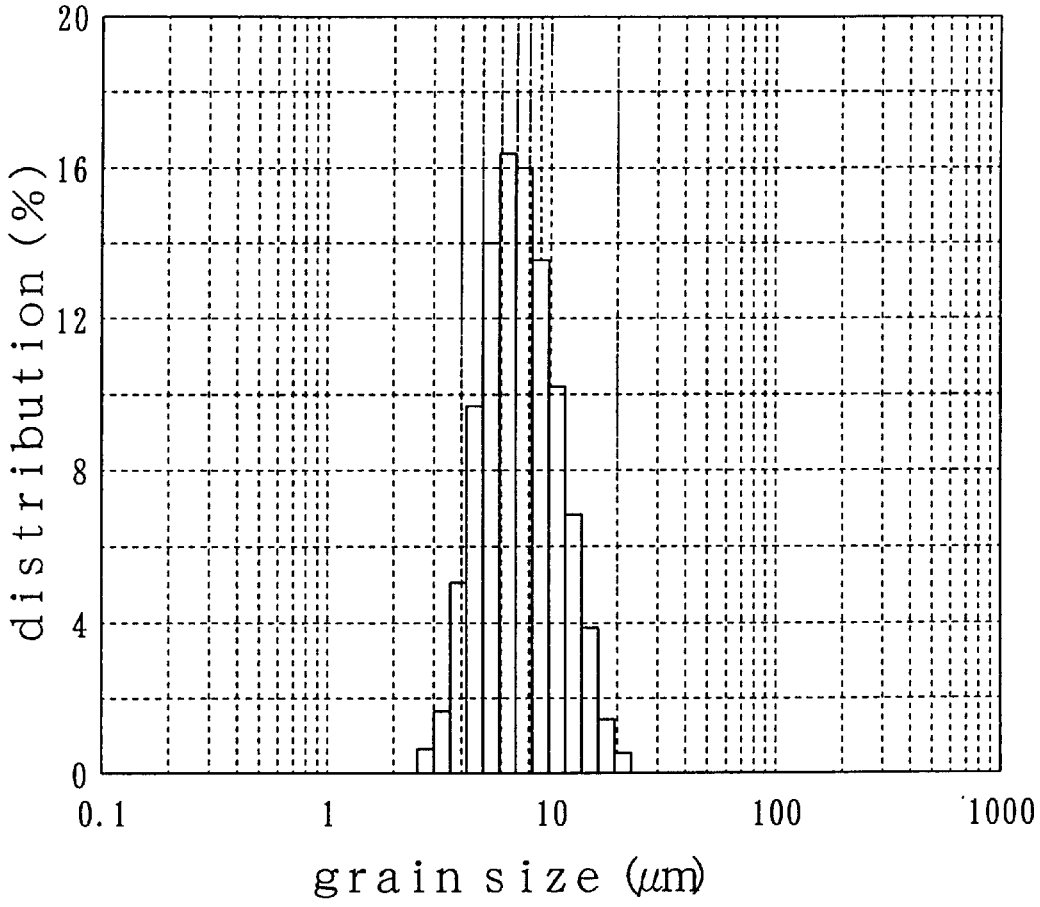
FIG. 11 is a view showing the dependency of micro powder on the grain size distribution (%) at a pressure of 7.5 $kgf/cm^2$ of high speed jet streams according to the third preferred embodiment of the invention.
Figure 12:
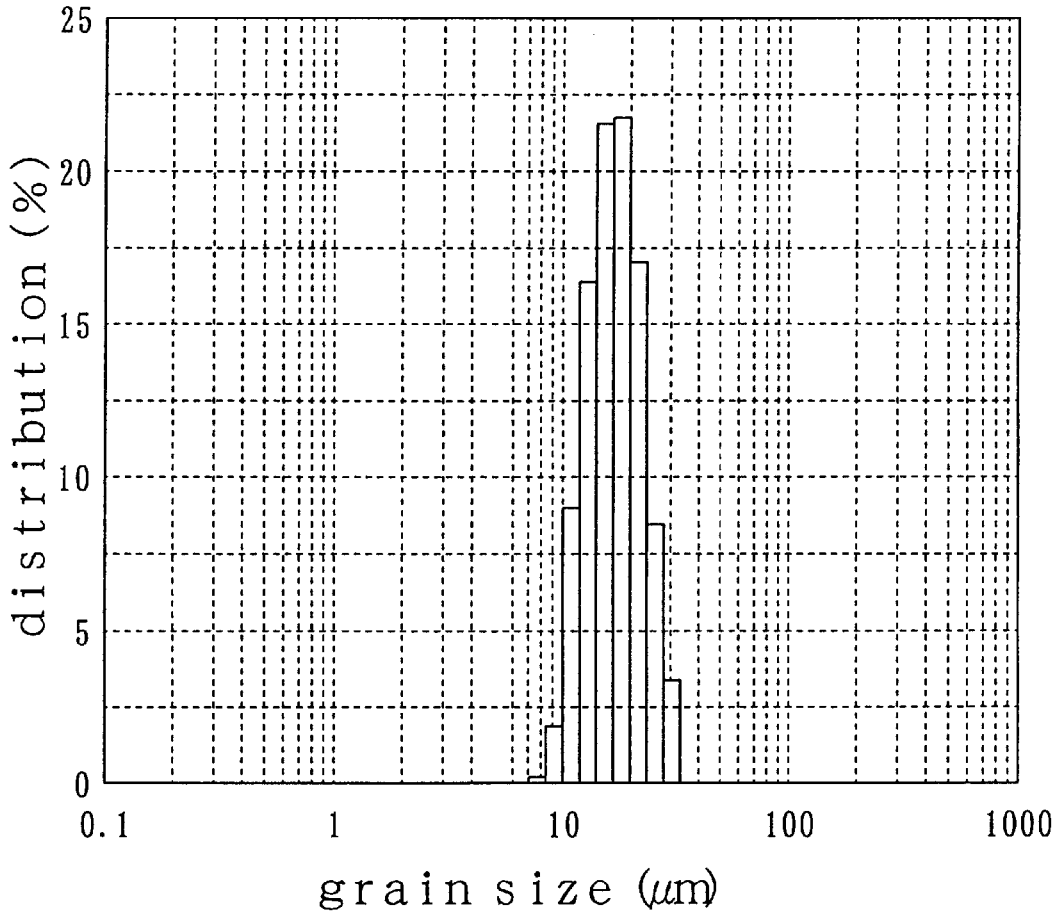
FIG. 12 is a view showing the dependency of micro powder on the grain size distribution (%) at a pressure of 4.5 $kgf/cm^2$ of high speed jet streams according to the third preferred embodiment of the invention.

The distribution range and grain size distribution of the crushed micro powder were measured by the same method as that of mode 2. FIG. 11 and FIG. 12 show the results of measurement. FIG. 11 is a view showing the dependency of micro powder on the grain size distribution (%) at a pressure of 7.5 kgf/cm$^2$ of high speed jet streams, and FIG. 12 is a view showing the dependency of micro powder on the grain size distribution (%) when the pressure of the high speed jet stream was 4.5 kgf/cm$^2$.

As has been made clear from FIG. 11 and FIG. 12, it was found that the grain size distribution of micro powder in FIG. 12 was 7.0 $\mu$m through 35.0 $\mu$m while that in FIG. 11 was 2.5 $\mu$m through 23.3 $\mu$m. Further, it was also found that almost no change occurred in the grain size distribution curve.

From the above, it was understood that the grain size could be freely changed at a narrow grain size distribution by only changing the pressure of the high speed jet stream.

What is claimed is:

1. A jet mill of a horizontal turning flow type, comprising a hollow disk-shaped turning and crushing chamber; a plurality ("m") of crushing nozzles, having an jetting port inclined to a circumferential wall side and disposed at a side wall of said turning and crushing chamber, which forms turning flows by jetting a high pressure gas; a plurality ("n") of venturi nozzles (however, m+n=a, a is an integral number, and m>n) for introducing materials to be crushed, in line with the high pressure gas, which are disposed at the side wall of said turning and crushing chamber; a solid and gas blending chamber, which is formed at the upstream side of said venturi nozzles; a crushed material supplying portion communicating with said solid and gas blending chamber; a press-in nozzle disposed in said solid and gas blending chamber coaxially with said venturi nozzles; and an outlet, disposed at the upper part of the center portion of said turning and crushing chamber, which discharges micro powder, wherein a distance 1 between a venturi nozzle lead-in portion of said solid and gas blending chamber and the discharge side of said press-in nozzle is expressed in terms of 1=(D/d)×k, a value k is k=7 through 12 (where D is the diameter of the venturi nozzle lead-in portion, and d is the diameter of the press-in nozzle at the discharge side).

2. A jet mill as set forth in claim 1, wherein said venturi nozzles are provided with a negative pressure generating portion between their throat portion and said venturi nozzle lead-in portion.

3. A jet mill as set forth in claim 1 or 2, wherein the total number m+n of said crushing nozzles and venturi nozzles is an even number, and $5 \leqq m \leqq 15$, $1 \leqq n \leqq 5$.

4. A jet mill as set forth in any one of claims 1 or 2, wherein the respective crushing nozzles are provided with "p" steps (however, $2 \leqq p \leqq 5$) of jet portions in the vertical direction and/or "q" rows (however, $1 \leqq q \leqq 5$) of jetting portions in the cross direction.

5. A jet mill as set forth in any one of claims 1 or 2, wherein at least one of the diameters of said and/or a jetting angle of said jetting ports is formed so as to differ from each other.

6. A jet mill as set forth in claim 4, wherein said jetting portions of said crushing nozzles have a plug inserting formed at the upstream side.

7. A jet mill as set forth in any one of claims 1, 2 or 6, further including a center pole disposed at the middle of the underside of said turning and crushing chamber, wherein the top point of said center pole and the lower end face of said outlet are located on the center surface in the height direction of said turning and crushing chamber.

8. A jet mill as set forth in claim 3, wherein said values m and n are $5 \leqq m \leqq 14$ and $1 \leqq n \leqq 2$.

9. A jet mill as set forth in claim 3, wherein the respective crushing nozzles are provided with "p" steps (however, $2 \leqq p \leqq 5$) of jet portions in the vertical direction and/or "q" rows (however, $1 \leqq q \leqq 5$) of jetting portions in the cross direction.

10. A jet mill as set forth in claim 3, wherein at least one of the diameters and/or a jetting angle of said jetting ports is formed so as to differ from each other.

11. A jet mill as set forth in claim 3, further including a center pole disposed at the middle of the underside of said turning and crushing chamber, wherein the top point of said center pole and the lower end face of said outlet are located on the center surface in the height direction of said turning and crushing chamber.

12. A jet mill as set forth in claim 4, wherein at least one of the diameters and/or a jetting angle of said jetting ports is formed so as to differ from each other.

13. A jet mill as set forth in claim 4, further including a center pole disposed at the middle of the underside of said turning and crushing chamber, wherein the top point of said center pole and the lower end face of said outlet are located on the center surface in the height direction of said turning and crushing chamber.

14. A jet mill as set forth in claim 5, wherein said jetting portions of said crushing nozzles have a plug inserting hole formed at the upstream side.

15. A jet mill as set forth in claim 5, further including a center pole disposed at the middle of the underside of said turning and crushing chamber, wherein the top point of said center pole and the lower end face of said outlet are located on the center surface in the height direction of said turning and crushing chamber.

16. A jet mill as set forth in claim 1, wherein said value k is k=8 through 10.

* * * * *